US011705044B2

(12) United States Patent
Roh et al.

(10) Patent No.: US 11,705,044 B2
(45) Date of Patent: Jul. 18, 2023

(54) DISPLAY DEVICE

(71) Applicant: Samsung Display Co., Ltd., Yongin-si (KR)

(72) Inventors: Jin Young Roh, Yongin-si (KR); Hyo Jin Lee, Yongin-si (KR); Jae Keun Lim, Yongin-si (KR); Hong Soo Kim, Yongin-si (KR); Se Hyuk Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/320,120

(22) Filed: May 13, 2021

(65) Prior Publication Data

US 2021/0390898 A1 Dec. 16, 2021

(30) Foreign Application Priority Data

Jun. 12, 2020 (KR) ..... 10-2020-0071543

(51) Int. Cl.
*G09G 3/20* (2006.01)
*G09G 3/3258* (2016.01)

(52) U.S. Cl.
CPC ..... *G09G 3/2003* (2013.01); *G09G 3/3258* (2013.01); *G09G 2310/027* (2013.01); *G09G 2310/0289* (2013.01); *G09G 2320/0233* (2013.01)

(58) Field of Classification Search
CPC ..... G09G 3/2003; G09G 2310/027; G09G 2310/0289; G09G 2320/0233; G09G 3/3258
See application file for complete search history.

(56) References Cited

U.S. PATENT DOCUMENTS

| | | | | |
|---|---|---|---|---|
| 8,817,008 | B2 | 8/2014 | Park et al. | |
| 9,019,188 | B2 | 4/2015 | Han et al. | |
| 11,295,659 | B2 * | 4/2022 | Lee | G09G 3/2092 |
| 2007/0285378 | A1 * | 12/2007 | Lankhorst | G09G 3/342 345/102 |

FOREIGN PATENT DOCUMENTS

| | | |
|---|---|---|
| KR | 10-1040786 | 6/2011 |
| KR | 10-1366253 | 2/2014 |
| KR | 10-2017-0109135 | 9/2017 |
| KR | 10-1954934 | 3/2019 |

* cited by examiner

*Primary Examiner* — Kenneth B Lee, Jr.
(74) *Attorney, Agent, or Firm* — H.C. Park & Associates, PLC

(57) ABSTRACT

A display device includes: a pixel part to display an image and including pixels receiving a reference voltage; a controller to determine a value of the reference voltage based on a load of the entire pixel part, and to control a grayscale range of image data according to a location in the pixel part based on the reference voltage; a data driver to supply data voltages to the pixel part through data lines based on grayscale ranges adjusted for each location in the pixel part; and a scan driver to supply a scan signal to the pixels through scan lines.

20 Claims, 11 Drawing Sheets

DISPLAY DEVICE

CROSS-REFERENCE TO RELATED APPLICATION

This application claims priority from and the benefit of Korean Patent Application No. 10-2020-0071543, filed on Jun. 12, 2020, which is hereby incorporated by reference for all purposes as if fully set forth herein.

BACKGROUND

Field

Exemplary implementations of the invention relate generally to a display device, and more particularly, to a display device capable of improving display quality when the display device is operated using low frequencies.

Discussion of the Background

A display device displays an image on a display panel by using control signals applied from the outside.

The display device includes a plurality of pixels. Each of the pixels includes a plurality of transistors, a light emitting device electrically coupled to the transistors, and a capacitor. The transistors generate a driving current, based on signals provided through a line, and the light emitting device emits light, corresponding to the driving current.

A display device for low power consumption is required to improve the driving efficiency of the display device. For example, the power consumption of the display device may be reduced by lowering a driving frequency (or data write frequency) when a still image is displayed.

The above information disclosed in this Background section is only for understanding of the background of the inventive concepts, and, therefore, it may contain information that does not constitute prior art.

SUMMARY

Applicant discovered that when display devices are is operated using low frequencies, a flicker phenomenon may occur due to the low-frequency driving operation that decrease image quality.

Display devices constructed according to the principles and exemplary implementations of the invention are capable of gradually decreasing a grayscale range with respect to a reference voltage as becoming more distant from a central portion of a pixel part (e.g., a display area) when a still image is displayed in low frequency driving. For example, in the low frequency driving, the display device may control the grayscale range (and a grayscale voltage range) to be narrowed as approaching an outer portion of the display area based on the reference voltage.

Further, display devices constructed according to the principles and exemplary implementations of the invention are capable of shifting a representative grayscale of a grayscale histogram in an area at the outside of a central portion of a pixel part with respect to a reference grayscale when a still image is displayed in low frequency driving. For example, in the low frequency driving, the display device may correct the grayscale histogram and the representative grayscale of each corresponding area to come closer to the reference grayscale as approaching the outer portion of the pixel part.

Accordingly, a difference between a grayscale voltage range, which corresponds to the outer portion of the pixel part, and the reference voltage supplied to a pixel can be decreased. Thus, current leakage in the pixel in an outer area to which zonal attenuation compensation is applied may be minimized, and a flicker at the outer area of the pixel part may be reduced in the low frequency driving in which a still image or the like is displayed.

Additional features of the inventive concepts will be set forth in the description which follows, and in part will be apparent from the description, or may be learned by practice of the inventive concepts.

According to an aspect of the invention, a display device includes: a pixel part to display an image, the pixel including pixels receiving a reference voltage; a controller to determine a value of the reference voltage based on a load of the entire pixel part, and control a grayscale range of image data according to a location in the pixel part based on the reference voltage; a data driver to supply data voltages to the pixel part through data lines based on grayscale ranges adjusted for each location; and a scan driver to supply a scan signal to the pixels through scan lines.

A difference between a maximum grayscale of image data corresponding to a second location of the pixel part and a reference grayscale corresponding to the reference voltage may be smaller than that between a maximum grayscale of image data corresponding to a first location of the pixel part and the reference grayscale, and a difference between a minimum grayscale of the image data corresponding to the second location and the reference grayscale may be smaller than that between a minimum grayscale of the image data corresponding to the first location and the reference grayscale. A distance from a central portion of the pixel part to the second location may be greater than that from the central portion to the first location.

A voltage difference between a voltage of the maximum grayscale corresponding to the second location and a voltage of the minimum grayscale corresponding to the second location may be smaller than that between a voltage of the maximum grayscale corresponding to the first location and a voltage of the minimum grayscale corresponding to the first location.

A grayscale range of the image data corresponding to the second location may be smaller than that of the image data corresponding to the first location.

The controller may be configured to decrease the reference voltage as the load increases.

A voltage difference between a voltage of a maximum grayscale at the central portion and a voltage of a maximum grayscale at an outer portion of the pixel part may be different from that between a voltage of a minimum grayscale at the central portion and a voltage of a minimum grayscale at the outer portion.

The controller may include: a reference voltage determiner to determine the reference voltage, based on an on-pixel ratio (OPR) of the pixel part; and a grayscale controller to remap grayscales of the image data such that a width of the grayscale range decreases as becoming more distance from the central portion of the pixel part, based on the reference voltage.

A voltage of a maximum grayscale of a first area including the central portion may be lower than that of a maximum grayscale of a second area including the outer portion of the pixel part, and a voltage of a minimum grayscale of the first area may be higher than that of a minimum grayscale of the second area.

The grayscale controller may be configured to determine a target maximum grayscale and a target minimum grayscale, which correspond to an edge area of the pixel part, based on the reference voltage. The maximum grayscale and the minimum grayscale of the edge area may be gradually changed in a predetermined period, to respectively reach the target maximum grayscale and the target minimum grayscale.

The display device may further include a zonal compensator to perform zonal attenuation compensation for differentially controlling a luminance according to spatial locations of the pixels, based on the load.

The zonal compensator may be configured to generate a zonal attenuation factor applied to the image data such that the luminance is decreased as becoming more distant from the central portion.

Each of the pixels may include: a light emitting device; a first transistor controlling a driving current, based on a voltage of a first node, the first transistor being coupled between a second node and a third node; a second transistor coupled between one of the data lines and the second node, the second transistor being turned on by a first scan signal supplied to a first scan line; a third transistor and a fourth transistor, coupled in series between the first node and the third node, the third transistor and the fourth transistor, being turned on by a second scan signal supplied to a second scan line; and a fifth transistor supplying the reference voltage to a fourth node between the third transistor and the fourth transistor, the fifth transistor being turned off by an emission control signal supplied to an emission control line.

Each of the pixels may further include: a sixth transistor coupled between a first power source and the second node, the sixth transistor being turned off by the emission control signal supplied to the light emission line; a seventh transistor coupled between the third node and the light emitting device, the seventh transistor being turned off by the emission control signal supplied to the light emission line; and an eighth transistor supplying an initialization voltage to the third node, the eighth transistor being turned on by a third scan signal supplied to a third scan line.

The pixels may be configured to operate in one of a first mode in which the data voltages are written at a first frequency and a second mode in which the data voltages are written at a second frequency. The second frequency may be lower than the first frequency. The controller may be configured to adjust the reference voltage and the grayscale range in the second mode.

According to another aspect of the invention, a display device includes: a pixel part including pixels arranged in a first area and a second area surrounding the first area; a controller to determine a value of a reference voltage supplied to the pixels and a reference grayscale corresponding to the reference voltage based on a load of the entire pixel part, and to control a grayscale histogram of image data of the second area based on the reference grayscale; a data driver to supply data voltages to the pixel part through data lines based on the image data; and a scan driver to supply a scan signal to the pixels through scan lines.

The controller may include: an image analyzer to determine, as the reference grayscale, an average value of a grayscale histogram of the entire pixel part, and to determine, as a first representative grayscale, an average value of the grayscale histogram of the second area; and a histogram shifter to shift the grayscale histogram of the second area such that the first representative grayscale is shifted toward the reference grayscale.

The controller may further include a distribution controller to reduce a histogram distribution of a first grayscale area including an over-grayscale area of the shifted grayscale histogram within a predetermined first grayscale such that the over-grayscale area is expressed.

The distribution controller may be configured to expand a grayscale histogram distribution of a second grayscale area up to a predetermined second grayscale such that grayscales of an insufficient grayscale area of the shifted grayscale histogram are expressed. Each of the first grayscale and the second grayscale may be one of a maximum grayscale and a minimum grayscale, which are set by the controller.

The pixel part may further include a third area surrounding the second area. The controller may be configured to shift a grayscale histogram of the third area such that a second representative grayscale as an average value of the grayscale histogram of the third area is shifted toward the reference grayscale. A grayscale difference between the shifted second representative grayscale and the reference grayscale may be smaller than that between the shifted first representative grayscale and the reference grayscale.

Each of the pixels may include: a light emitting device; a first transistor controlling a driving current, based on a voltage of a first node, the first transistor being coupled between a second node and a third node; a second transistor coupled between one of the data lines and the second node, the second transistor being turned on by a first scan signal supplied to a first scan line; a third transistor and a fourth transistor, coupled in series between the first node and the third node, the third transistor and the fourth transistor, being turned on by a second scan signal supplied to a second scan line; and a fifth transistor supplying the reference voltage to a fourth node between the third transistor and the fourth transistor, the fifth transistor being turned off by an emission control signal supplied to an emission control line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
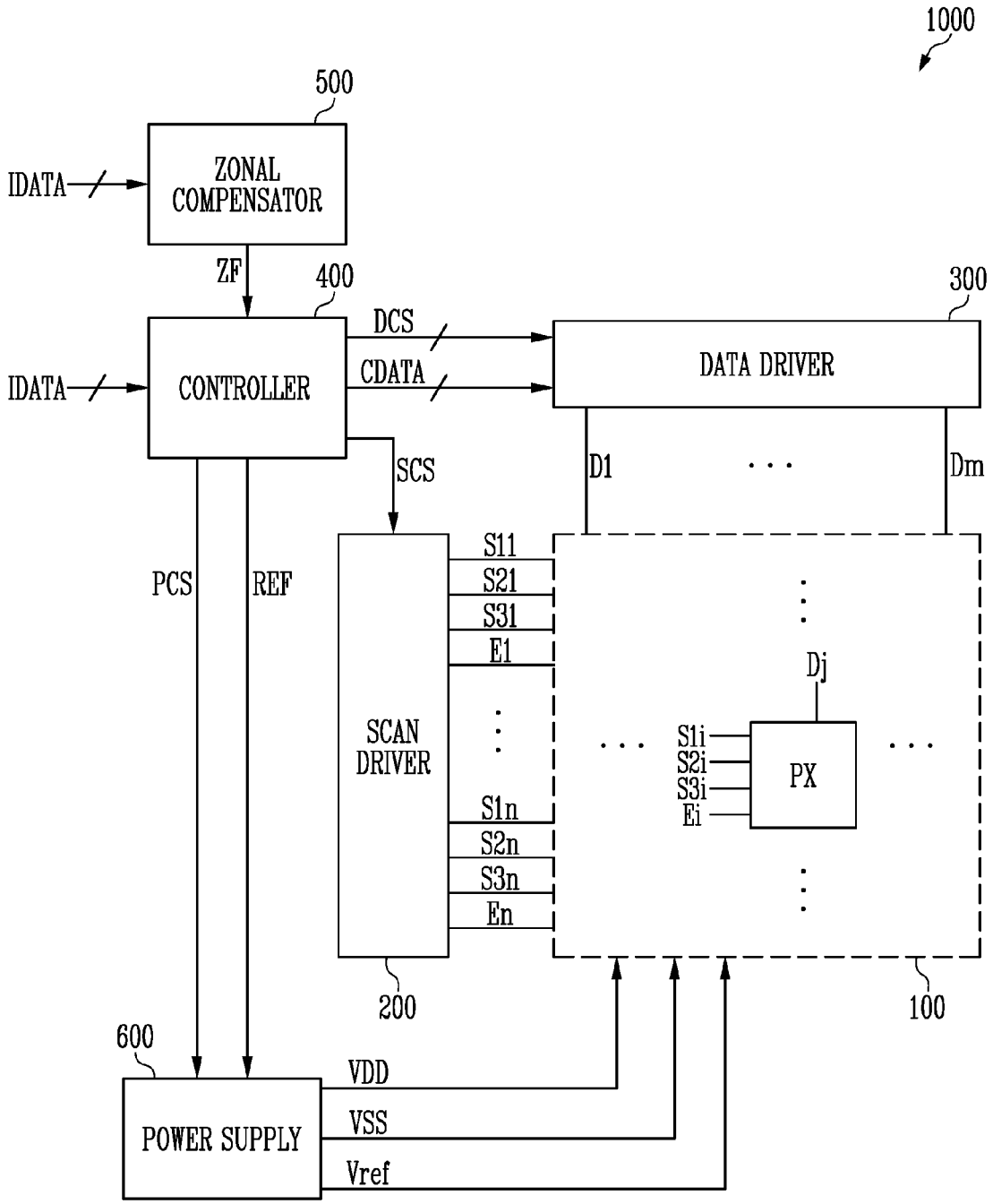
FIG. 1 is a block diagram of an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an exemplary embodiment of a display device constructed according to the principles of the invention.

Referring to FIG. 1, the display device 1000 may include a pixel part 100, a scan driver 200, a data driver 300, and a controller 400. The display device 1000 may further include a zonal compensator 500 and a power supply 600.

The pixel part 100 may include scan lines S11 to S1*n*, S21 to S2*n*, and S31 to S3*n*, emission control lines E1 to En, and data lines D1 to Dm, and include pixels PX coupled to the scan lines S11 to S1*n*, S21 to S2*n*, and S31 to S3*n*, the emission control lines E1 to En, and the data lines D1 to Dm (m and n are integers greater than 1). Each of the pixels PX may include a driving transistor and a plurality of switching transistors. In row frequency driving, a reference voltage Vref may be supplied to the pixels PX so as to prevent a leakage current in the pixels PX.

The controller 400 may generate a first control signal SCS, a second control signal DCS, and a third control signal PCS, corresponding to synchronization signals supplied from the outside. The first control signal SCS may be supplied to the scan driver 200, the second control signal DCS may be supplied to the data driver 300, and the third control signal PCS may be supplied to the power supply 600. Also, the controller 400 may correct image data IDATA supplied from the outside, and supply the corrected image data CDATA to the data driver 300. That is, the controller 400 may perform a function of a timing controller.

The controller 400 may determine a reference voltage Vref, based on a load of the entire pixel part 100. For example, the controller 400 may supply reference data REF corresponding to the reference voltage Vref to the power supply 600.

The controller 400 may control a grayscale range (or grayscale expression range) of the image data IDATA according to a location in the pixel part 100, based on the reference voltage Vref. The controller 400 may change a maximum grayscale and a minimum grayscale to become closer to a grayscale corresponding to the reference voltage Vref as becoming more distant from a central portion of the pixel part 100. For example, a voltage difference between a voltage of the maximum grayscale and a voltage of the minimum grayscale may be decreased as becoming more distant from the central portion of the pixel part 100.

In another exemplary embodiment, the controller 400 may determine a reference grayscale corresponding to the reference voltage Vref, and control a grayscale histogram of at least some of the image data IDATA, based on the reference grayscale.

A configuration and an operation of the controller 400 will be described in detail with reference to FIGS. 5 to 11.

The scan driver 200 may receive the first control signal SCS from the controller 400, and may supply a first scan signal, a second scan signal, and a third scan signal respectively to first scan lines S11 to S1*n*, second scan lines S21 to S2*n*, and third scan lines S31 to S3*n*. Also, the scan driver 200 may supply an emission control signal to the emission control line E1 to En.

For example, the first scan signal may be sequentially supplied to the first scan lines S11 to S1*n*, the second scan signal may be sequentially supplied to the second scan line S21 to S2*n*, and the third scan signal may be sequentially supplied to the third scan lines S31 to S3*n*. The emission control signal may be sequentially supplied to the emission control lines E1 to En.

The scan signal may be set to a gate-on voltage (e.g., a low voltage). A transistor receiving the scan signal may be set to a turn-on state when the scan signal is supplied.

The emission control signal may be set to a gate-off voltage (e.g., a high voltage). A transistor receiving the emission control signal may be turned off when the emission control signal is supplied, and be set to the turn-on state in other cases.

The scan driver 200 may be mounted on a substrate through a thin film process. Although a case where a single scan driver supplies the first to third scan signals and the emission control signal has been illustrated in FIG. 1, the present disclosure is not limited thereto. In an example, the scan driver 200 may include a plurality of scan drivers, each of which supplies at least one of the first to third scan signals and the emission control signal.

The data driver 300 may receive the second control signal DCS and the corrected image data CDATA. The data driver 300 may supply a data signal (or data voltage) to the data lines D1 to Dm, corresponding to the second control signal DCS.

The zonal compensator 500 may perform zonal attenuation compensation for differentially controlling a luminance according to spatial locations of the pixels PX, based on a load of the pixel part 100, which corresponds to a degree of data signal (or data voltage) applied to the pixel part 100. In an exemplary embodiment, the zonal compensator 500 may generate a zonal attenuation factor ZF applied to image data DATA such that the luminance is decreased as becoming more distant from the central portion of the pixel part 100.

For example, the zonal attenuation compensation may mean a luminance compensation method for gradually decreasing the luminance as approaching an outer portion from the center of the pixel part 100. Accordingly, a dark image can be displayed in an outer area of the pixel part 100, as compared with the central portion of the pixel part 100, the feeling of immersion can be improved, and power consumption can be reduced. In an exemplary embodiment, a luminance distribution of the corrected image data CDATA may have a Gaussian distribution from the central portion of the pixel part 100.

The display device 1000 may operate in one of a first mode (or a normal mode) in which data voltages are written at a first frequency so as to display a moving image, etc. and a second mode (or a low power consumption mode) in which data voltages are written at a second frequency so as to display a still image, etc. The second frequency may be set to a value lower than that of the first frequency. For example, the second frequency may be 30 Hz or lower, and the first frequency may be 60 Hz or higher.

In low frequency driving operation of the second mode, leakage of a driving current may occur in the pixel PX, and a flicker may be viewed due to such current leakage. A pixel shown in FIG. 2 may be proposed so as to prevent or minimize the current leakage. That is, a flicker in the low frequency driving may be minimized by supplying the reference voltage to the pixel PX. In addition, according to a flicker recognition characteristic of a user, there is a tendency in that a flicker is better recognized at a peripheral viewpoint than at a central viewpoint of the user.

Figure 8:
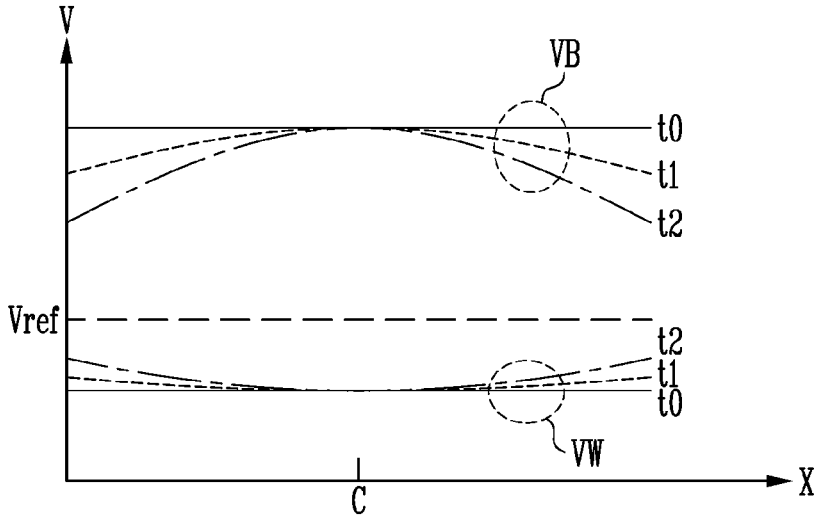
FIG. 8 is a graph illustrating another exemplary embodiment of the change in data voltage corresponding to each of the maximum and minimum grayscales output by the controller shown in FIG. 5.
Figure 9:
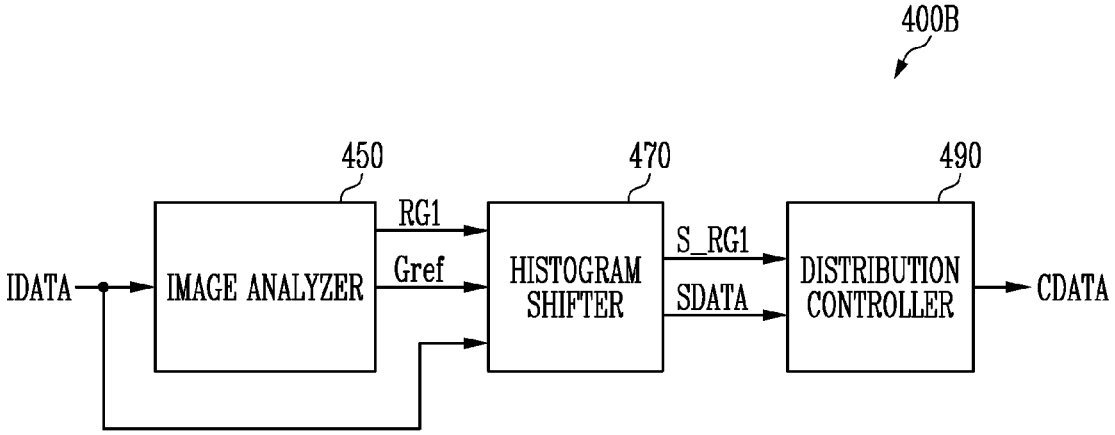
FIG. 9 is a block diagram of another exemplary embodiment of the controller included in the display device shown in FIG. 1.
Figure 10A:
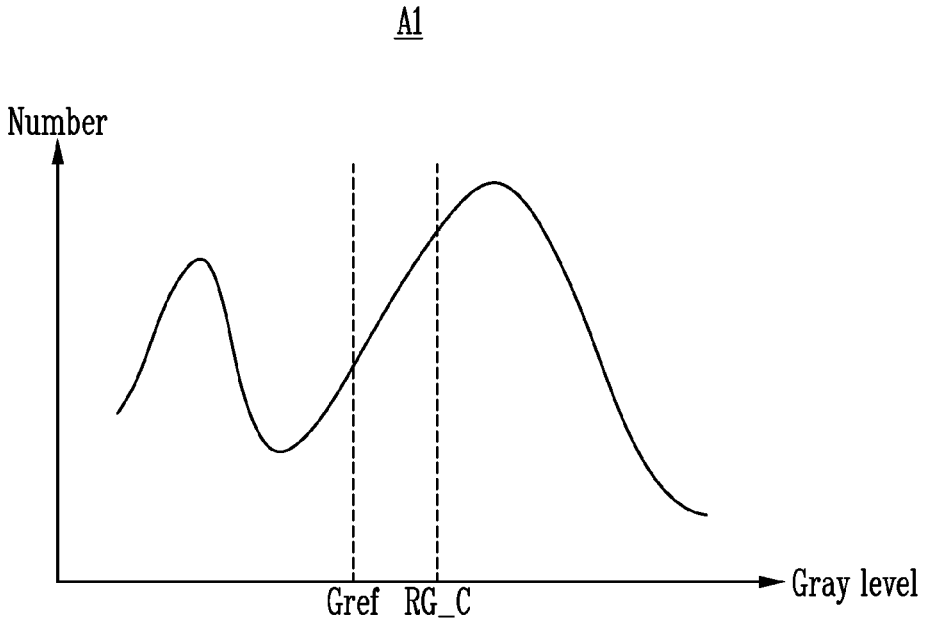
FIG. 10A is a graph of an exemplary embodiment of a grayscale histogram of a first area A1 of the pixel part shown in FIG. 4.
Figure 10B:
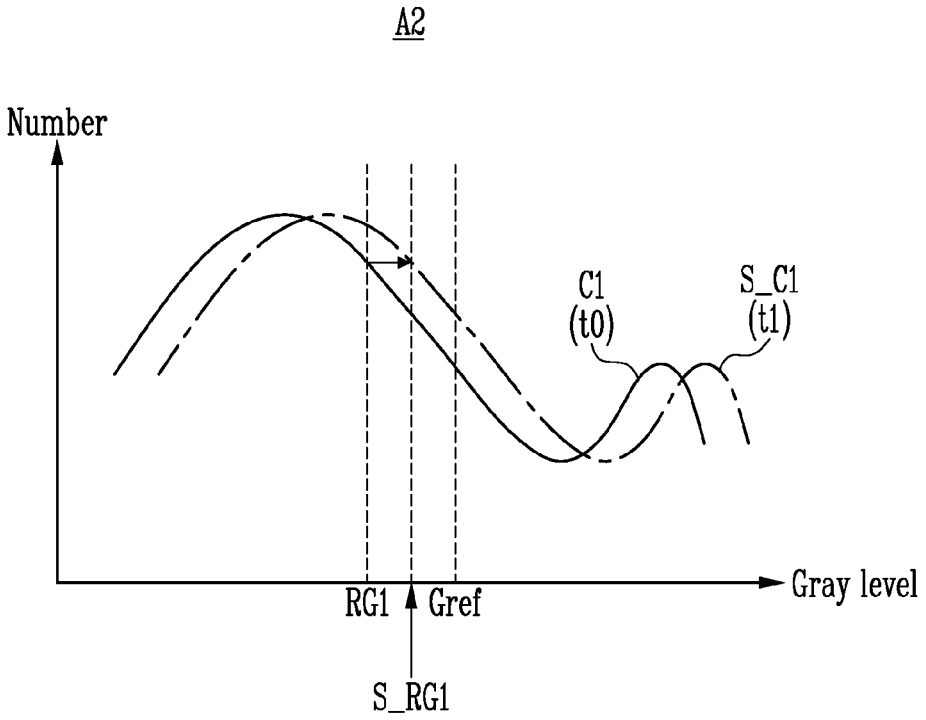
FIG. 10B is a graph of an exemplary embodiment in which a grayscale histogram of a second area A2 of the pixel part shown in FIG. 4 is shifted.
Figure 10C:
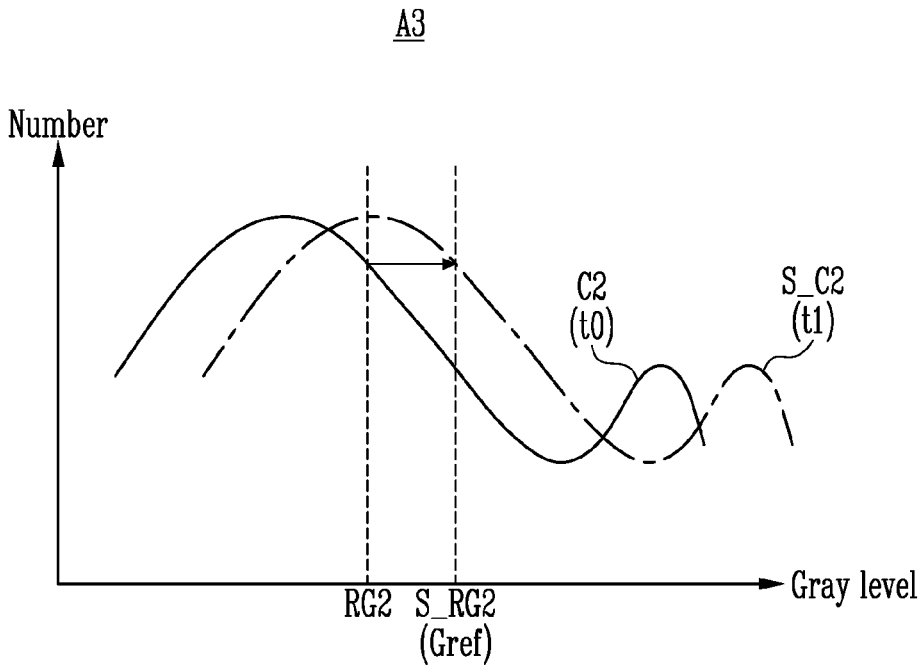
FIG. 10C is a graph of an exemplary embodiment in which a grayscale histogram of a third area A3 of the pixel part shown in FIG. 4 is shifted.
Figure 11:
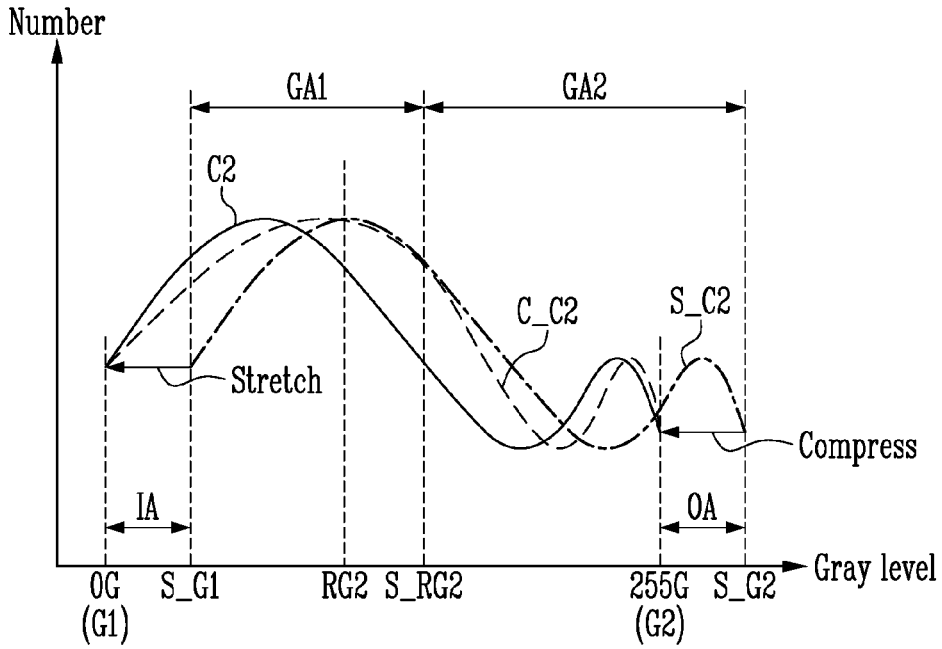
FIG. 11 is a graph of an exemplary embodiment in which a grayscale histogram is corrected by the controller shown in FIG. 9.

In order to improve the recognition of a flicker at the peripheral viewpoint (i.e., an outer area of the pixel part 100), the controller 400 may adjust a grayscale range with respect to a reference voltage Vref and a reference grayscale corresponding thereto (see FIGS. 5 to 8), or shift a representative grayscale of a grayscale histogram in the outer area with respect to the reference grayscale (see FIGS. 9 to 11). That is, the recognition of a flicker in an outer area of the display device 1000 in which the zonal attenuation compensation and the low frequency driving are performed can be minimized through correction of the image data IDATA.

Figure 2:
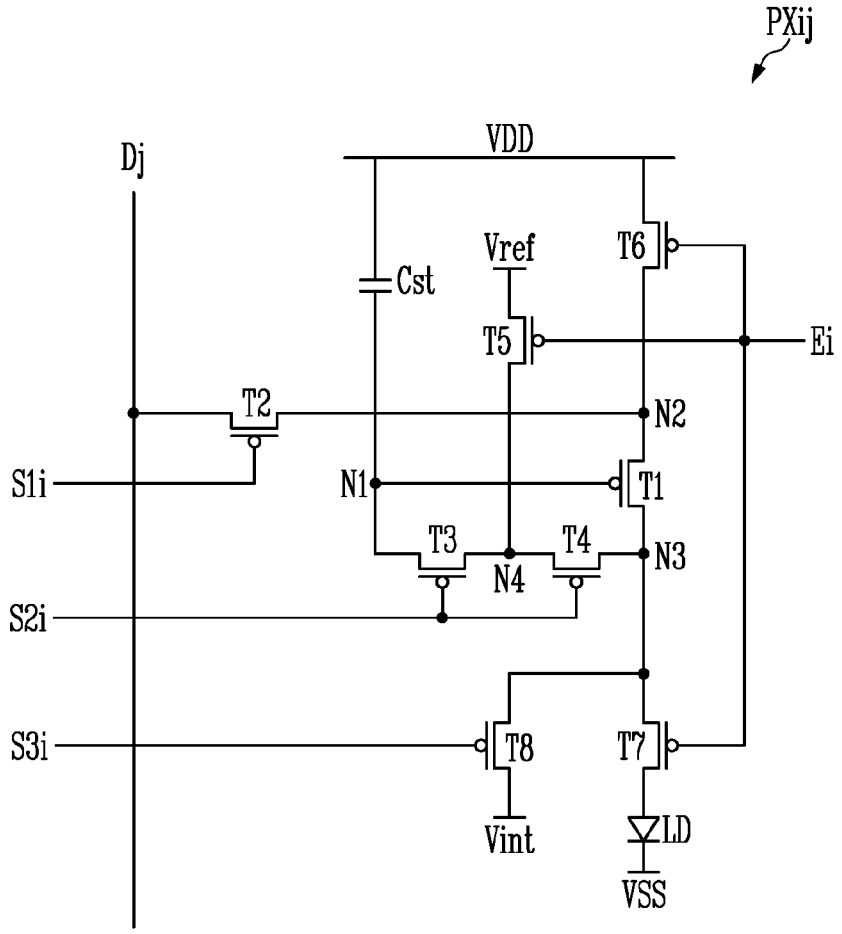
FIG. 2 is a circuit diagram of an exemplary embodiment of a representative pixel included in the display device shown in FIG. 1.

FIG. 2 is a circuit diagram of an exemplary embodiment of a representative pixel included in the display device shown in FIG. 1.

For convenience of description, a pixel PXij which is located on an ith horizontal line (or an ith pixel row) and is coupled to a jth data line Dj will be illustrated in FIG. 2 (i and j are natural numbers).

Referring to FIG. 2, the pixel PXij may include a light emitting device LD, first to eighth transistor T1 to T8, and a storage capacitor Cst.

A first electrode (, anode electrode or cathode electrode) of the light emitting device LD may be coupled to the seventh transistor T7, and a second electrode (, cathode electrode or anode electrode) of the light emitting device LD may be coupled to a second power source VSS. The light emitting device LD may generate light with a predetermined luminance corresponding to an amount of current supplied from the first transistor T1.

In an exemplary embodiment, the light emitting device LD may be an organic light emitting diode including an organic emitting layer. In another exemplary embodiment, the light emitting device LD may be an inorganic light emitting device formed of an inorganic material. In another exemplary embodiment, the light emitting device LD may be a light emitting device complexly configured with an inorganic material and an organic material. Alternatively, the light emitting device LD may have a form in which a plurality of inorganic light emitting devices are coupled in parallel and/or series between the second power source VSS and the seventh transistor T7.

The first transistor T1 (or driving transistor) may be coupled between a second node N2 and a third node N3. A gate electrode of the first transistor T1 may be coupled to a first node N1. The first transistor T1 may control an amount of current (driving current) flowing from a first power source VDD to the second power source via the light emitting device LD, based on a voltage of the first node N1. To this end, the first power source VDD may be set to a voltage higher than that of the second power source VSS.

The second transistor T2 may be coupled between the jth data line Dj (hereinafter, referred to as a data line) and the second node N2. A gate electrode of the second transistor T2 may be coupled to an ith first scan line S1*i* (hereinafter, referred to as a first scan line). The second transistor T2 may be turned on when the first scan signal is supplied to the first scan line S1*i*, to allow the data line Dj and the second node N2 to be electrically coupled to each other.

The third transistor T3 and the fourth transistor T4 may be coupled in series between the first node N1 and the third node N3. A gate electrode of the third transistor T3 and a gate electrode of the fourth transistor T4 may be coupled to an ith second scan line S2*i* (hereinafter, referred to as a second scan line). The third transistor T3 and the fourth transistor T4 may be turned on by the second scan signal supplied to the second scan line S2*i*.

Meanwhile, a parasitic capacitance component may exist in a fourth node N4 and the second scan line S2*i* due to a physically stacked structure of the transistors. The fifth transistor T5 capable of directly controlling a voltage of a fourth node N4 may be added so as to prevent unintended current leakage caused by such a parasitic capacitance.

The fifth transistor T5 may be coupled to the fourth node N4 between the third transistor T3 and the fourth transistor T4. The fifth transistor T5 may supply a reference voltage Vref to the fourth node N4. A gate electrode of the fifth transistor T5 may be coupled to an ith emission control line Ei (hereinafter, referred to as an emission control line). The fifth transistor T5 may be turned off by an emission control signal (high level) supplied to the emission control line Ei. That is, the fifth transistor T5 may be turned on in an emission period to supply the reference voltage Vref to the fourth node N4.

In an exemplary embodiment, the reference voltage Vref may be a value included in a data voltage range determined by a grayscale range. For example, the reference voltage Vref may be a median value of the data voltage range. Since the reference voltage Vref has a value between a black grayscale voltage and a white grayscale voltage, a source-drain voltage Vds of the third transistor T3 in the emission period in which the second scan signal is not supplied may be controlled at a low level. Thus, a current path to the third and fourth transistors T3 and T4 in the emission period is suppressed, and accordingly, driving current leakage can be reduced.

The sixth transistor T6 may be coupled between the first power source VDD and the second node N2. A gate electrode of the sixth transistor T6 may be coupled to the emission control line Ei. The seventh transistor T7 may be coupled between the third node N3 and the light emitting device LD. A gate electrode of the seventh transistor T7 may be coupled to the emission control line Ei. The sixth transistor T6 and the seventh transistors T7 may be turned off when the emission control signal is supplied to the emission control line Ei, and be turned on in other cases.

The eighth transistor T8 may be coupled to the third node N3. A gate electrode of the eighth transistor T8 may be coupled to an ith third scan line S3*i* (hereinafter, referred to as a third scan line). The eighth transistor T8 may be turned on by the third scan signal supplied to the third scan line S3*i*, to supply an initialization voltage Vint to the third node N3.

The storage capacitor Cst may be coupled between the first power source VDD and the first node N1.

Figure 3:
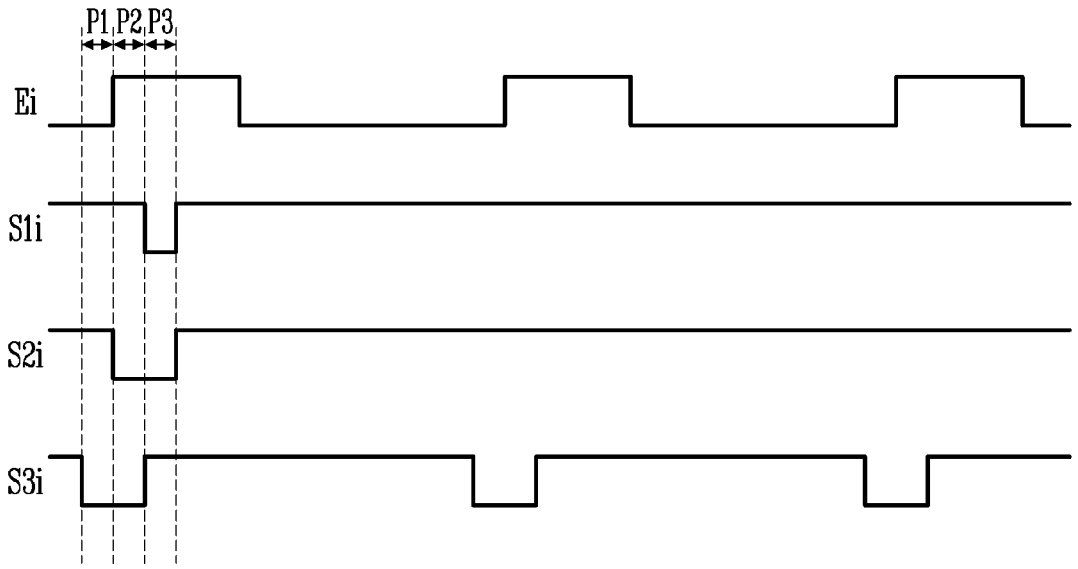
FIG. 3 is a timing diagram of an exemplary embodiment of signals supplied to the pixel shown in FIG. 2.

FIG. 3 is a timing diagram of an exemplary embodiment of signals supplied to the pixel shown in FIG. 2.

Referring to FIGS. 1 to 3, the pixel PXij and the display device 1000 including the same may operate in a low frequency driving (low power consumption driving) for displaying a still image, etc.

In the low frequency driving operation of the second mode, the emission control signal and the third scan signal may be supplied at a first frequency, and the first scan signal and the second scan signal may be supplied at a second frequency lower than the first frequency. For example, the first frequency may be 60 Hz, and the second frequency may be 10 Hz. That is, as shown in FIG. 3, the frequency of the first scan signal supplied to the first scan line S1*i* and the second scan signal supplied to the second scan line S2*i* may be lower than that at which the third scan signal is supplied.

In another exemplary embodiment, the emission control signal, the first scan signal, the second scan signal, and the third scan signal may all be supplied at the same frequency in the first mode (normal mode).

A period in which the emission control signal has a low level except a first period P1 may be an emission period, and a period except the emission period may be a non-emission period.

The third scan signal may be supplied to the third scan line S3*i* in the first period P1 in which the fifth to seventh transistors T5 to T7 have the turn-on state. The eighth transistor T8 may be turned on in the first period P1, so that the initialization voltage Vint is supplied to the light emitting device LD. That is, an anode voltage of the light emitting device LD may be initialized in the first period P1.

In a second period P2, a high level of the emission control signal, a low level of the second scan signal, and a low level of the third scan signal may be supplied. The fifth to seventh transistors T5 to T7 may be turned off, and the third and fourth transistors T3 and T4 may be turned on. The eighth transistor T8 may maintain the turn-on state. Therefore, the initialization voltage Vint may be supplied to the first node N1. That is, a gate voltage of the first transistor T1 may be initialized in the second period P2.

In a third period P3, the supply of the third scan signal is suspended, and the first scan signal may be supplied to the first scan line S1*i*. In the third period P3, the eighth transistor T8 may be turned off, and the second transistor T2 may be turned on. The third and fourth transistors T3 and T4 may maintain the turn-on state. Therefore, the first transistor T1 may be diode-coupled. In the third period P3, data writing and threshold voltage compensation may be performed on the pixel PXij.

Subsequently, when the supply of the emission control signal to the emission control line Ei is suspended (i.e., when the emission control signal having a low level is supplied), the fifth to seventh transistors T5 to T7 may be turned on, so that the pixel PXij emits light.

The reference voltage Vref may be applied through the fifth transistor T5 so as to suppress an increase in drain-source voltage of the third and fourth transistors T3 and T4 due to the parasitic capacitance in the second mode.

However, since the reference voltage Vref is commonly supplied to all pixels, it is difficult to control an optimum leakage current of each of the pixels to which various data voltages are supplied. In particular, in the display device 1000 to which the zonal attenuation compensation is applied, the outer area of the pixel part 100 emits light with a relatively low luminance, as compared with the central portion of the pixel part 100, and therefore, additional image data compensation for controlling a leakage current and a flicker at an outer portion of the pixel part 100 is required.

Figure 4:
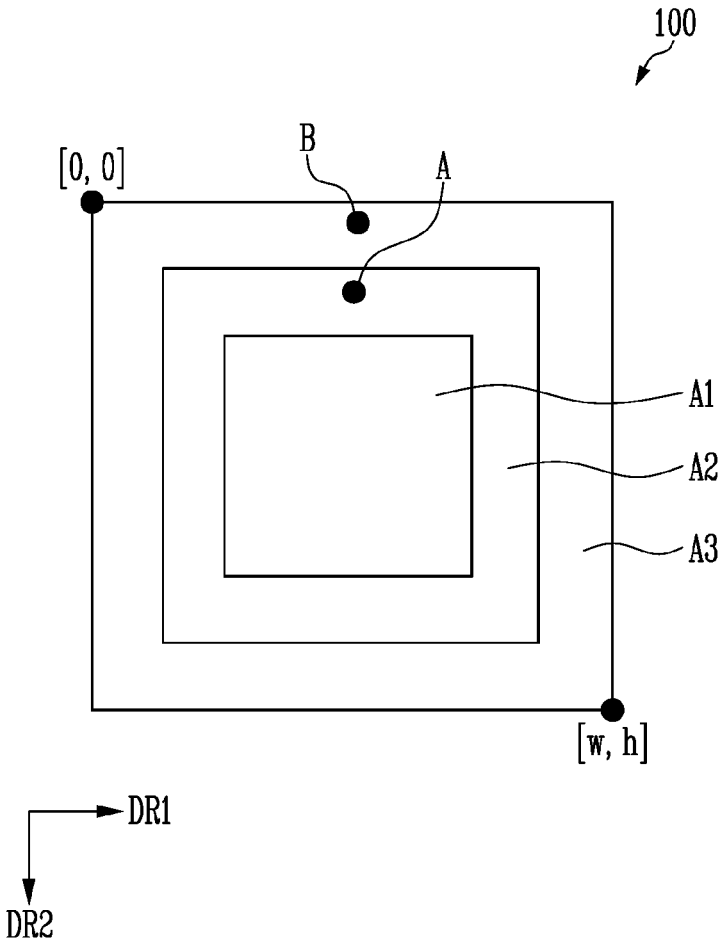
FIG. 4 is a diagram of an exemplary embodiment in which a luminance is compensated by a zonal compensator included in the display device shown in FIG. 1.

FIG. 4 is a diagram of an exemplary embodiment in which a luminance is compensated by the zonal compensator included in the display device shown in FIG. 1.

Referring to FIGS. 1 and 4, the zonal compensator 500 may perform zonal attenuation compensation for differentially controlling a luminance according to spatial locations of the pixels, based on a load of the pixel part 100.

In an exemplary embodiment, the load of the pixel part 100 may be derived from an on-pixel ratio. That is, the load may be calculated from a ratio of pixels emitting light among all the pixels or a rate of a luminance of a current frame with respect to a maximum luminance. For example, the zonal compensator 500 may convert image data IDATA into luminance data, and calculate a total load of the pixel part 100, based on the luminance data. A brighter image may be displayed from the pixel part 100 as the load of pixel part 100 increases.

The zonal compensator 500 may determine a zonal attenuation factor ZF applied to compensation of the image data IDATA, based on the load of pixel part 100. The zonal compensator 500 may determine a zonal attenuation factor ZF by using a lookup table in which the zonal attenuation factor ZF is set according to a size of the load. For example, the zonal attenuation factor ZF may be linearly or nonlinearly set in the lookup table in proportion to an increase in the load of pixel part 100. Alternatively, the zonal attenuation factor ZF may be determined by interpolation based on values set in the lookup table.

In some exemplary embodiments, the zonal attenuation factor ZF increases as the load increases, and therefore, a degree to which the luminance is decreased as becoming more distant from the central portion of the pixel part 100 may increase.

In an exemplary embodiment, the compensation of the image data IDATA according to the zonal attenuation factor ZF may be applied to pixels included in a predetermined outer area of the pixel part 100. The zonal attenuation compensation may be performed on only the outer area.

A spatial location of a pixel corresponding to the image data IDATA may be extracted by using, as factors, coordinate values x and y representing a location of the pixel. For example, referring to FIG. 4, a left upper end of the pixel part 100 may become [x,y]=[0,0], and a right lower end of the pixel part 100 may become [x,y]=[width (w) of image, height (h) of image]. Accordingly, in a method for performing the zonal attenuation compensation, the location of the pixel may increase the degree to which the luminance is decreased as becoming more distant from the central portion of the pixel part 100. In an exemplary embodiment, a luminance distribution of the image data IDATA to which the zonal attenuation factor ZF is applied may have a Gaussian distribution from the central portion of the pixel part 100.

For example, referring to FIG. 4, when the same grayscale is expressed, a luminance of a second area A2 at the periphery of a first area A1 may be lower than that of the first area A1. In addition, when the same grayscale is expressed, a luminance of a third area A3 at the periphery of the second area A2 may be lower than that of the second area A2. For example, when the same grayscale is expressed, a luminance of a pixel at a second location B of the third area A3 may be lower than that of a pixel at a first location A of the second area A2.

Figure 5:
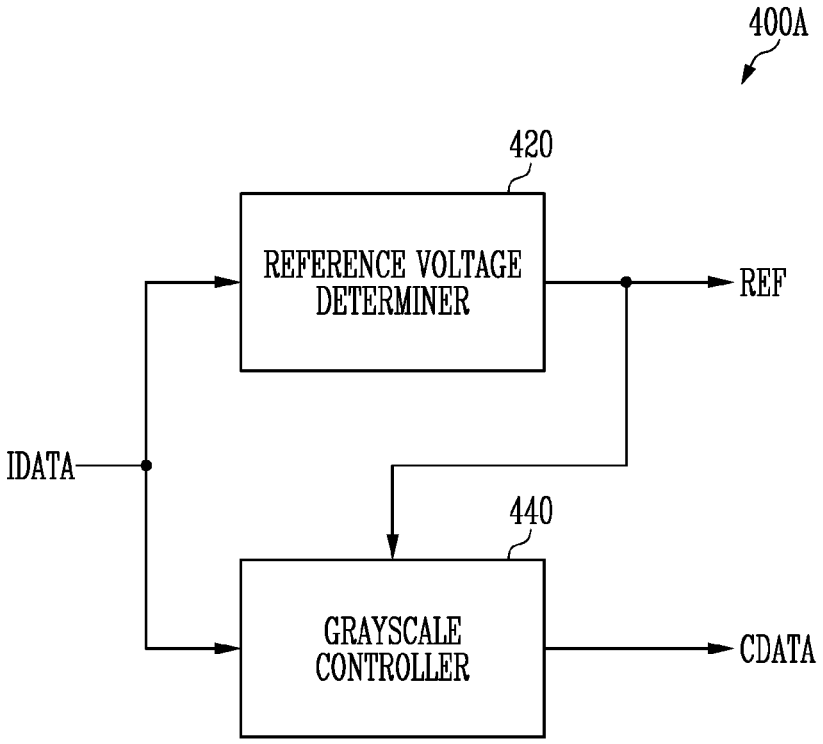
FIG. 5 is a block diagram of an exemplary embodiment of the controller included in the display device shown in FIG. 1.
Figure 6:
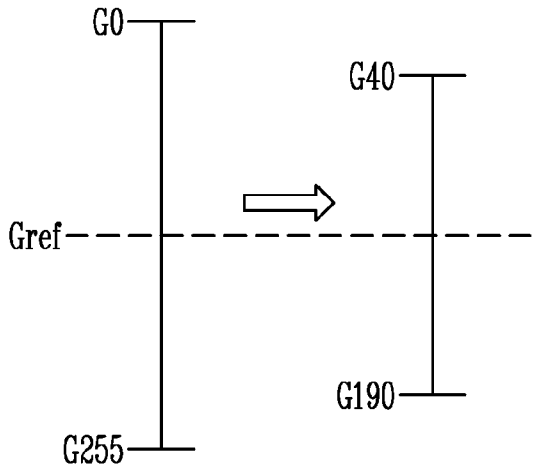
FIG. 6 is a diagram of an exemplary embodiment in which the controller shown in FIG. 5 controls a grayscale range.

FIG. 5 is a block diagram of an exemplary embodiment of the controller included in the display device shown in FIG. 1. FIG. 6 is a diagram illustrating an example in which the controller shown in FIG. 5 controls a grayscale range.

Referring to FIGS. 1, 4, 5, and 6, a controller 400A may include a reference voltage determiner 420 and a grayscale controller 440.

The reference voltage determiner 420 may determine a reference voltage Vref, based on a load of the pixel part 100. In an exemplary embodiment, a load of the pixel part 100 may be determined according to an on-pixel ratio, and reference data REF corresponding to the corresponding load may be generated.

The reference voltage determiner 420 may calculate an on-pixel ratio by using image data IDATA. The on-pixel ratio may be calculated from a ratio of pixels emitting light among all the pixels or an average grayscale of all the pixels.

The reference voltage determiner 420 may include a lookup table in which reference data REF corresponding to the on-pixel ratio and the load is set. The reference data REF may be a digital value capable of determining a magnitude of the reference voltage Vref.

In an exemplary embodiment, in the case of a bright image (first image) having a large average grayscale, data voltages supplied to pixels including a PMOS driving transistor (the first transistor T1 shown in FIG. 2) may be averagely formed low. On the contrary, in the case of an image (second image) having a relatively low average grayscale, data voltages supplied to the pixels may be relatively high. Therefore, a reference voltage Vref corresponding to the first image having a relatively large load may be determined as a voltage lower than a reference voltage Vref corresponding to the second image having a relatively small load. In other words, the reference voltage determiner 420 may decrease the reference voltage Vref as the load (on-pixel ratio) of pixel part 100 increases.

The reference voltage determiner 420 may supply the reference data REF to the grayscale controller 440 and the power supply 600.

The grayscale controller 440 may remap grayscales of the image data IDATA such that the width of the grayscale range decreases as becoming more distant from the central portion of the pixel part 100, based on reference data REF corresponding to the reference voltage Vref. The grayscale controller 440 may correct the image data IDATA or a grayscale of the image data IDATA to which the zonal attenuation factor ZF is applied. For example, the grayscale controller 440 may include a lookup table in which grayscales set according to the reference data REF are stored, a hardware circuit configuration, and/or an algorithm.

The remapped image data IDATA may be output as corrected image data CDATA to be provided to the data driver 300.

The grayscale range may be determined by a maximum grayscale and a minimum grayscale, which can be expressed. In an exemplary embodiment, the grayscale controller 440 may change the maximum grayscale and the minimum grayscale to be closer to a grayscale corresponding to the reference voltage Vref as becoming more distant from the central portion of the pixel part 100. Accordingly, the voltage difference between a voltage of the maximum grayscale and a voltage of the minimum grayscale can decrease as becoming more distant from the central portion of the pixel part 100.

In an exemplary embodiment, the grayscale range may gradually decrease as becoming more distant from the central portion of the pixel part 100. For example, the corrected image data CDATA may be expressed as shown in FIG. 6. Image data DATA supplied from an external graphic source, etc. may be expressed with 256 grayscales of a 0-grayscale G0 to a 255-grayscale G255. The 0-grayscale G0 may be a black grayscale, and the 255-grayscale G255 may be a white grayscale. A reference grayscale Gref corresponding to the reference voltage Vref may be a grayscale between the 0-grayscale G0 to the 255-grayscale G255.

In addition, image data of the first area A1 of FIG. 4 may be expressed with a grayscale range of the 0-grayscale G0 to the 255-grayscale G255 without grayscale remapping. The grayscale controller 440 may remap image data of the third area A3 of FIG. 4. For example, a grayscale range applied to the third area A3 may be expressed with a 40-grayscale G40 to a 190-grayscale G190. That is, the 0-grayscale G0 to the 255-grayscale G255 may be respectively remapped to the 40-grayscale G40 to the 190-grayscale G190, so that the grayscale range is decreased. Therefore, a data voltage supplied to an outer area of the central portion may converge as values closer to the reference voltage Vref.

Accordingly, data voltages supplied to pixels PX of an outer area (e.g., the second and third areas A2 and A3 shown in FIG. 4) in which it is likely that a flicker will be easily recognized by the zonal attenuation compensation may be adjusted to a value relatively closer to the reference value Vref. Therefore, the difference between a voltage of the fourth node N4 of the pixel and a voltage of the first node N1 (and the third node N3) of the pixel is further decreased as approaching the third area A3 from the first area A1, so that current leakage in the pixel in an outer area of the pixel part 100 can be minimized. Thus, a flicker at an outer portion of the pixel part 100, to which the zonal attenuation compensation is applied, can be reduced.

Figure 7A:
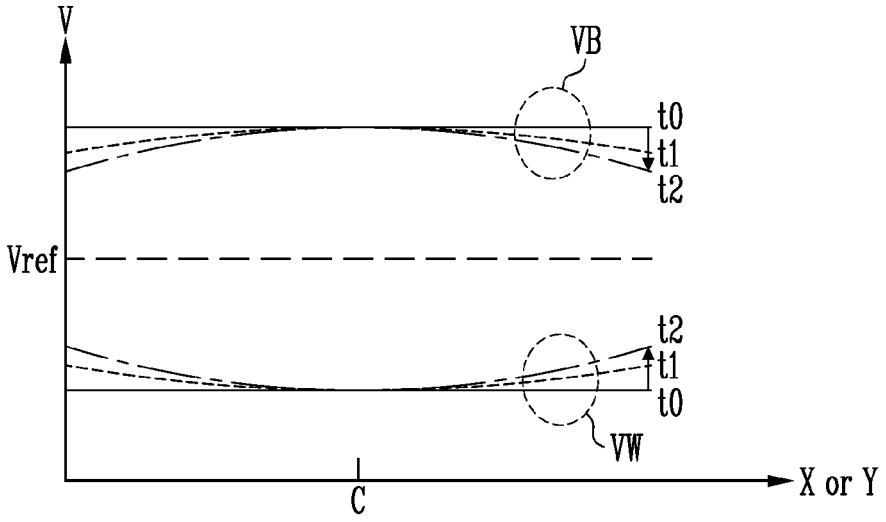
FIGS. 7A and 7B are graphs illustrating exemplary embodiments of a change in data voltage corresponding to each of maximum and minimum grayscales output by the controller shown in FIG. 5.
Figure 7B:
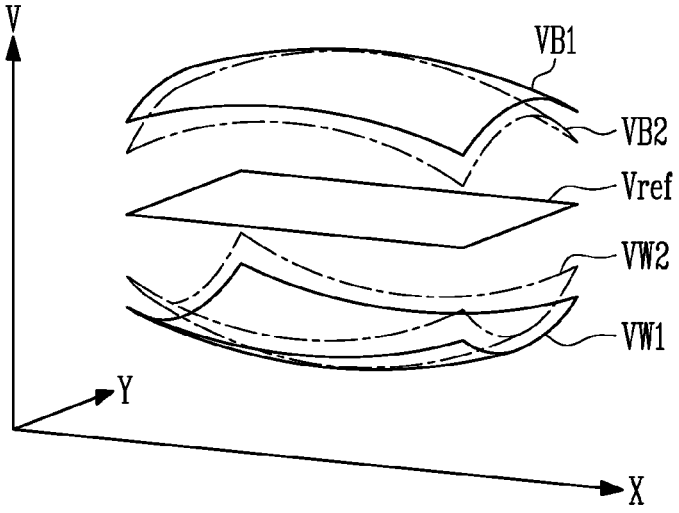

FIGS. 7A and 7B are graphs illustrating exemplary embodiments of a change in data voltage corresponding to each of the maximum and minimum grayscales output by the controller shown in FIG. 5.

Referring to FIGS. 4 to 7B, the range of a data voltage may be changed depending on a location in the pixel part 100.

FIG. 7A illustrates a change in data voltage (or grayscale voltage V) in an x-axis direction X corresponding to a first direction DR1 or a y-axis direction Y corresponding to a second direction DR2 from a central portion C of the pixel part 100. The voltage of the maximum grayscale may be expressed as a white voltage VW, and the voltage of the minimum grayscale may be expressed as a black voltage VB. The reference voltage Vref may be a median value between the white voltage VW and the black voltage VB, which corresponds to the central portion C.

As shown in FIG. 7A, a voltage difference between the white voltage VW and the black voltage VB may decrease as becoming more distant in the x-axis direction X and/or the y-axis direction Y from the central portion C of the pixel part 100. In some exemplary embodiments, the grayscale range may gradually decrease as becoming more distant from the central portion C of the pixel part 100. Therefore, the black voltage VB may be set to have a convex shape with respect to the central portion C, and the white voltage VW may be set to have a concave shape with respect to the central portion C.

For example, a voltage difference between a white voltage VW and a black voltage VB of a pixel corresponding to the second location (B shown in FIG. 4) may be smaller than that between a white voltage VW and a black voltage VB of a pixel corresponding to the first location (A shown in FIG. 4).

The other grayscales between the black grayscale and the white grayscale may be expressed as voltages between the black voltage VB and the white voltage VW, based on a grayscale remapping result.

In driving of the second mode in which a still image is displayed, the grayscale range may be gradually decreased in a predetermined period such that a change of the still image due to a sudden change in grayscale range for each location is not recognized by a user.

In an exemplary embodiment, the grayscale controller 440 may determine a target maximum grayscale and a target minimum grayscale, which correspond to an edge area (e.g., an edge of the third area A3 shown in FIG. 4) of the pixel part 100 when the display device 1000 enters into the second mode.

Referring to FIG. 7A, a black voltage VB and a white voltage VW may be expressed as a solid line when the display device 1000 enters into the second mode at t0. A maximum grayscale and a minimum grayscale of the edge area may be gradually changed until the maximum grayscale and the minimum grayscale respectively reach the target maximum grayscale and the target minimum grayscale as shown in FIG. 7A. The gradual change in grayscale range according to the time lapse may be exposed as a change in grayscale voltage V such as t0, t1 or t2. That is, referring to FIG. 7A, a black voltage VB and a white voltage VW of the outer portion at a second time t2 may come closer to the reference voltage Vref than a black voltage VB and a white voltage VW of the outer portion at a first time t1.

FIG. 7B illustrates a spatial change and a temporal change of black voltages VB1 and VB2 and white voltages VW1 and VW2 (i.e., a difference between VB1 and VB2 and a difference between VW1 and VW2) with respect to a two-dimensional plane of the pixel part 100.

As described above, the display device 1000 may control the grayscale range (and grayscale voltage range) to be narrowed as approaching an outer portion of the pixel part 100 with respect to the reference voltage Vref in the low frequency driving of the second mode. Therefore, current leakage in the pixel in an outer area to which the zonal attenuation compensation is applied can be minimized. Thus, a flicker at the outer portion of the pixel part 100 can be reduced in the low frequency driving in which a still image or the like is displayed, and image quality can be improved in the low frequency driving.

FIG. 8 is a graph illustrating another exemplary embodiment of the change in data voltage corresponding to each of the maximum and minimum grayscales output by the controller shown in FIG. 5.

Referring to FIGS. 5, 7A, and 8, a reference voltage Vref may be differently determined according to a size of a load.

In an exemplary embodiment, the controller 400A may decrease the reference voltage Vref as the load of the pixel part 100 increases. The reference voltage Vref shown in FIG. 8 may be set to have a relatively low voltage value, as compared with FIG. 7A. In addition, a voltage difference between a voltage (white voltage VW) of a maximum grayscale at the central portion C and a voltage (white voltage VW) of a maximum grayscale at the outer portion may be different from that between a voltage (black voltage VB) of a minimum grayscale at the central portion C and a voltage (black voltage VB) of a minimum grayscale at the outer portion.

As shown in FIG. 8, when the reference voltage Vref is closer to the white voltage VW than the black voltage VB applied to the central portion C of the pixel part 100, a spatial change amount of the black voltage VB may be greater than that of the white voltage VW. In addition, a temporal change amount (t0→t1→t2) of the black voltage VB may be greater than that (t0→t1→t2) of the white voltage VW.

On the contrary, when the reference voltage Vref is closer to the black voltage VB than the white voltage VW applied to the central portion C of the pixel part 100, a spatial change amount of the black voltage VB may be smaller than that of the white voltage VW. In addition, a temporal change of the black voltage VB may be smaller than that of the white voltage VW.

FIG. 9 is a block diagram of another exemplary embodiment of the controller included in the display device shown in FIG. 1. FIG. 10A is a graph of an exemplary embodiment of a grayscale histogram of the first area A1 of the pixel part shown in FIG. 4. FIG. 10B is a graph of an exemplary embodiment in which the grayscale histogram of the second area A2 of the pixel part shown in FIG. 4 is shifted. FIG. 10C is a graph of an exemplary embodiment of in which the grayscale histogram of the third area A3 of the pixel part shown in FIG. 4 is shifted.

Referring to FIGS. 1, 4, and 9, a controller 400B may determine a reference voltage Vref supplied to the pixels PX and a reference grayscale Gref corresponding to the reference voltage Vref, based on a load of the entire pixel part 100, and control a grayscale histogram of image data of the second area A2 (and the third area A3), based on the reference grayscale Gref.

In an exemplary embodiment, the controller 400B may include an image analyzer 450, a histogram shifter 470, and a distribution controller 490.

The image analyzer 450 may calculate a grayscale histogram by analyzing grayscale information included in image data IDATA. The grayscale histogram may include information for a number of pixels corresponding to each grayscale in one frame.

The image analyzer 450 may determine, as a reference grayscale Gref, an average value of a grayscale histogram of the entire pixel part 100, and determine, as a first representative grayscale RG1, an average value of a grayscale histogram of the second area A2. Similarly, the image analyzer 450 may determine, as a second representative grayscale (RG2 shown in FIG. 10C), an average value of a grayscale histogram of the third area A3.

The histogram shifter 470 may shift the entire histogram of the second area A2 such that the first representative grayscale RG1 is shifted toward the reference grayscale Gref. The histogram shifter 470 may shift a total grayscale of image data corresponding to the second area A2 by a change amount with which the first representative grayscale RG1 is shifted to a target grayscale. For example, when the first representative grayscale RG1 is shifted by ten grayscales in a positive direction, grayscales of the second area A2 may be converted to be shifted by ten grayscales in the positive direction. This grayscale shift may be implemented by using various techniques known in the art, such as grayscale remapping. The shifted image data SDATA may be provided to the distribution controller 490.

Similarly, the histogram shifter 470 may shift the entire grayscale histogram of the third area A3 such that the second representative grayscale (RG2 shown in FIG. 10C) is shifted toward the reference grayscale Gref. A change amount of the first representative grayscale RG1 and a change amount of the second representative grayscale (RG2 shown in FIG. 10C) may be different from each other. In an exemplary embodiment, a grayscale difference between a shifted second representative grayscale (S_RG2 shown in FIG. 10C) and the reference grayscale Gref may be controlled to be smaller than that between a shifted first representative grayscale S_RG1 and the reference grayscale Gref. For example, a representative grayscale of a corresponding area may be shifted to a value closer to the reference grayscale Gref as approaching the outer portion of the pixel part 100.

The distribution controller 490 may reduce a histogram distribution of a partial area (over-grayscale area) of a shifted image histogram such that the shifted image data SDATA can be expressed in a grayscale range and a gamma voltage range, which are set in the display device. Also, the distribution controller 490 may expand a histogram distribution of another partial area (insufficient grayscale area) of the shifted image histogram. A grayscale of image data CDATA corrected by the distribution controller 490 may be included in a grayscale range set by the display device.

Hereinafter, an operation of the controller 400B will be described in detail with reference to FIGS. 10A to 11.

Referring to FIGS. 4, 9, 10A, 10B, and 10C, the controller 400B may shift a representative grayscale and all grayscales of image data DATA including the representative grayscale according to an area of the pixel part 100.

As shown in FIG. 10A, the image analyzer 450 may calculate a representative grayscale RG_C of the first area A1 by analyzing the grayscale histogram of the first area A1. The representative grayscale RG_C of the first area A1 may be different from the reference grayscale Gref.

Since the first area A1 is an area which includes main information of an image and has view of a user to be concentrated thereon, the controller 400B does not shift image data of the first area A1 and the representative grayscale RG_C.

As shown in FIG. 10B, the image analyzer 450 may calculate a first representative grayscale RG1 by analyzing the grayscale histogram of the second area A2. The histogram shifter 470 may shift the first representative grayscale RG1 toward the reference grayscale Gref, and shift the entire grayscale histogram according to a grayscale change amount of the shifted first representative grayscale S_RG1.

For example, a first grayscale histogram C1 when the display device 1000 enters into the second mode in which a still image is displayed (t0) may be corrected to a second grayscale histogram S_C1 shifted toward the reference grayscale Gref at the first time t1.

As shown in FIG. 10C, the image analyzer 450 may calculate a second representative grayscale RG2 by analyzing the grayscale histogram of the third area 3A. The histogram shifter 470 may shift the second representative grayscale RG2 toward the reference grayscale Gref, and shift the entire grayscale histogram according to a grayscale change amount of the shifted second representative grayscale S_GR2.

For example, a second grayscale histogram C2 when the display device 1000 enters into the second mode in which a still image is displayed (t0) may be corrected to a fourth grayscale histogram S_C2 shifted toward the reference grayscale Gref at the first time t1. In some exemplary embodiments, the shifted second representative grayscale S_GR2 may be equal to the reference grayscale Gref.

As shown in FIGS. 10B and 10C, a grayscale difference between the shifted second representative grayscale S_GR2 and the reference grayscale Gref may be smaller than that between the shifted representative grayscale S_RG1 and the reference grayscale Gref. That is, the representative grayscale of the grayscale histogram may be corrected to be closer to the reference grayscale Gref as approaching an outer portion of the pixel part 100.

Accordingly, grayscales and a grayscale range of image data corresponding to an outer portion of the pixel part 100 are corrected to values close to the reference grayscale Gref, and a difference between a grayscale voltage range (data voltage range) corresponding to the grayscales and the grayscale range and a reference voltage Vref supplied to a pixel can be decreased. Thus, current leakage in the pixel in an outer area to which the zonal attenuation compensation is applied can be minimized.

Further, as shown in FIGS. 10B and 10C, each of grayscale histograms of corresponding areas can be shifted such that a representative grayscale gradually comes closer to the reference grayscale Gref as approaching an outer area of the pixel part 100.

FIG. 11 is a graph of an exemplary embodiment of in which a grayscale histogram is corrected by the controller shown in FIG. 9.

Referring to FIGS. 9 to 11, the controller 400B may include a distribution controller 490 which adjust a histogram distribution of a shifted grayscale histogram S_C2.

An expressible grayscale range and a grayscale voltage range corresponding thereto may be set in the display device. That is, grayscale voltages corresponding to a grayscale range between a first grayscale G1 and a second grayscale G2 may be output. For example, as shown in FIG. 11, the first grayscale G1 in the grayscale range may be set as the 0-grayscale G0, the second grayscale G2 may be set as the 255-grayscale G255, the grayscale range may be expressed with 8-bit digital values.

However, according to an operation of the histogram shifter 470, the shifted grayscale histogram S_C2 may be out of a predetermined grayscale range. For example, a low-grayscale excitation phenomenon may be viewed by a user due to a shifted first grayscale S_G1, or image quality may be deteriorated since a high-grayscale area is not expressed by a shifted second grayscale S_G2.

The distribution controller 490 may expand a histogram distribution of an insufficient grayscale area IA through remapping, interpolation, etc. on the shifted image data SDATA, and reduce a histogram distribution of an over-grayscale area OA. Referring to FIG. 11, the insufficient grayscale area IA may be a grayscale range between the first grayscale G1 as an area in which any grayscale is not expressed by a grayscale histogram shift and the shifted first grayscale S_G1. In addition, the over-grayscale area OA may be a grayscale range between the second grayscale G2 as an area which is out of the expressible grayscale range and the shifted second grayscale S_G2. Although a case where the grayscale histogram C2 is shifted to the right is illustrated in FIG. 11, the exemplary embodiment is not limited thereto, and the grayscale histogram C2 may be shifted to the left. The insufficient grayscale area IA and the over-grayscale area OA may be set to locations opposite to those shown in FIG. 11.

The distribution controller 490 may expand a histogram distribution of a first grayscale area GA1 up to the first grayscale G1 including the insufficient grayscale area IA such that a grayscale of the insufficient grayscale area IA of the shifted grayscale histogram S_C2 is expressed. The first grayscale area GA1 may be a grayscale range between the shifted representative grayscale S_RG2 and the shifted grayscale S_G1. That is, an image in a grayscale range (i.e., GA1+IA) including the first grayscale area GA1 and the insufficient grayscale area IA may be displayed through the expansion of the grayscale histogram.

Image data is corrected such that a grayscale histogram corresponding to the first grayscale area GA1 is expanded up to the first grayscale G1. Thus, low-grayscale excitation can be prevented from being viewed by a user.

Also, the distribution controller 490 may reduce a grayscale histogram distribution of a second grayscale area GA2 within the second grayscale G2 such that the over-grayscale area OA of the shifted grayscale histogram S_C2 is expressed. The second grayscale area GA2 may be a grayscale range between the shifted representative grayscale S_RG2 and the shifted second grayscale S_G2. That is, an image in a grayscale range (i.e., GA2-OA) obtained by excluding the over-grayscale area OA from the second grayscale area GA2 may be displayed through the reduction of the grayscale histogram.

Image data is corrected such that a grayscale histogram corresponding to the second grayscale area GA2 is reduced within an expressible grayscale. Thus, image quality can be improved.

As described above, the distribution controller 490 may generate corrected image data CDATA including a corrected grayscale histogram C_C2. The data driver (300 shown in FIG. 1) may generate a data signal, based on the corrected image data CDATA.

As described above, in the low frequency driving, the display device controls a grayscale range (and a grayscale voltage range) to be narrowed as approaching an outer portion of the pixel part with respect to a reference voltage (see Vref shown in FIG. 2). Also, in the low frequency driving, the display device corrects a grayscale histogram and a representative grayscale (see RG1 shown in FIG. 9) of each corresponding area to come closer to a reference grayscale Gref as approaching the outer portion of the pixel part.

Accordingly, a difference between a grayscale voltage range, which corresponds to the outer portion of the pixel part, and the reference voltage Vref supplied to a pixel can be decreased. Thus, current leakage in the pixel in an outer area to which zonal attenuation compensation is applied can be minimized, and a flicker at the outer portion of the pixel part can be reduced in the low frequency driving in which a still image or the like is displayed.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a pixel part to display an image and including pixels receiving a reference voltage;

a controller to determine a value of the reference voltage based on a load of the pixel part, and to control a grayscale range of image data according to a location in the pixel part based on the reference voltage;

a data driver to supply data voltages to the pixel part through data lines based on grayscale ranges adjusted for each location in the pixel part; and a scan driver to supply scan signals to the pixels through scan lines.

2. The display device of claim 1, wherein a difference between a maximum grayscale of image data corresponding to a first location of the pixel part and a reference grayscale corresponding to the reference voltage is greater than a difference between a maximum grayscale of image data corresponding to a second location of the pixel part and the reference grayscale, and a difference between a minimum grayscale of the image data corresponding to the first location and the reference grayscale is greater than a difference between a minimum grayscale of the image data corresponding to the second location and the reference grayscale, and wherein a distance from a central portion of the pixel part to the second location is greater than that from the central portion to the first location.

3. The display device of claim 2, wherein a voltage difference between a voltage of the maximum grayscale corresponding to the second location and a voltage of the minimum grayscale corresponding to the second location is smaller than a voltage difference between a voltage of the maximum grayscale corresponding to the first location and a voltage of the minimum grayscale corresponding to the first location.

4. The display device of claim 2, wherein a grayscale range of the image data corresponding to the second location is smaller than a grayscale range of the image data corresponding to the first location.

5. The display device of claim 2, wherein the controller is configured to decrease the reference voltage as the load increases.

6. The display device of claim 5, wherein a voltage difference between a voltage of a maximum grayscale at the central portion and a voltage of a maximum grayscale at an outer portion of the pixel part is different from a voltage difference between a voltage of a minimum grayscale at the central portion and a voltage of a minimum grayscale at the outer portion.

7. The display device of claim 1, wherein the controller comprises:

a reference voltage determiner to determine the reference voltage based on an on-pixel ratio (OPR) of the pixel part; and a grayscale controller to remap grayscales of the image data such that a width of the grayscale range decreases as becoming more distance from the central portion of the pixel part, based on the reference voltage.

8. The display device of claim 7, wherein a voltage of a maximum grayscale of a first area including the central portion is lower than a voltage of a maximum grayscale of a second area including the outer portion of the pixel part, and a voltage of a minimum grayscale of the first area is higher than a voltage of a minimum grayscale of the second area.

9. The display device of claim 7, wherein the grayscale controller is configured to determine a target maximum grayscale and a target minimum grayscale, which correspond to an edge area of the pixel part, based on the reference voltage, and wherein the maximum grayscale and the minimum grayscale of the edge area are gradually changed in a predetermined period, to respectively reach the target maximum grayscale and the target minimum grayscale.

10. The display device of claim 2, further comprising:

a zonal compensator to perform zonal attenuation compensation for differentially controlling a luminance according to spatial locations of the pixels, based on the load.

11. The display device of claim 10, wherein the zonal compensator is configured to generate a zonal attenuation factor applied to the image data such that the luminance is decreased as becoming more distant from the central portion.

12. The display device of claim 2, wherein each of the pixels comprises:

a light emitting device;

a first transistor configured to control a driving current, based on a voltage of a first node, the first transistor being coupled between a second node and a third node;

a second transistor coupled between one of the data lines and the second node, the second transistor being turned on by a first scan signal supplied to a first scan line;

a third transistor and a fourth transistor, coupled in series between the first node and the third node, the third transistor and the fourth transistor, being turned on by a second scan signal supplied to a second scan line; and a fifth transistor supplying the reference voltage to a fourth node between the third transistor and the fourth transistor, the fifth transistor being turned off by an emission control signal supplied to an emission control line.

13. The display device of claim 12, wherein each of the pixels further comprises:

a sixth transistor coupled between a first power source and the second node, the sixth transistor being turned off by the emission control signal supplied to the light emission line;

a seventh transistor coupled between the third node and the light emitting device, the seventh transistor being turned off by the emission control signal supplied to the light emission line; and an eighth transistor configured to supply an initialization voltage to the third node, the eighth transistor being turned on by a third scan signal supplied to a third scan line.

14. The display device of claim 13, wherein the pixels are configured to operate in one of a first mode in which the data voltages are written at a first frequency and a second mode in which the data voltages are written at a second frequency, wherein the second frequency is lower than the first frequency, and wherein the controller is configured to adjust the reference voltage and the grayscale range in the second mode.

15. A display device comprising:

a pixel part including pixels arranged in a first area and a second area surrounding the first area;

a controller to determine a value of a reference voltage supplied to the pixels and a reference grayscale corresponding to the reference voltage based on a load of the entire pixel part, and to control a grayscale histogram of image data of the second area based on the reference grayscale;

a data driver to supply data voltages to the pixel part through data lines based on the image data; and a scan driver to supply scan signals to the pixels through scan lines.

16. The display device of claim 15, wherein the controller comprises:

an image analyzer to determine, as the reference grayscale, an average value of a grayscale histogram of the entire pixel part, and to determine, as a first representative grayscale, an average value of the grayscale histogram of the second area; and a histogram shifter to shift the grayscale histogram of the second area such that the first representative grayscale is shifted toward the reference grayscale.

17. The display device of claim 16, wherein the controller further comprises:

a distribution controller to reduce a histogram distribution of a first grayscale area including an over-grayscale area of the shifted grayscale histogram within a predetermined first grayscale such that the over-grayscale area is expressed.

18. The display device of claim 17, wherein the distribution controller is configured to expand a grayscale histogram distribution of a second grayscale area up to a predetermined second grayscale such that grayscales of an insufficient grayscale area of the shifted grayscale histogram are expressed, and wherein each of the first grayscale and the second grayscale is one of a maximum grayscale and a minimum grayscale, which are set by the controller.

19. The display device of claim 17, wherein the pixel part further includes a third area surrounding the second area, wherein the controller is configured to shift a grayscale histogram of the third area such that a second representative grayscale as an average value of the grayscale histogram of the third area is shifted toward the reference grayscale, and wherein a grayscale difference between the shifted second representative grayscale and the reference grayscale is smaller than that between the shifted first representative grayscale and the reference grayscale.

20. The display device of claim 17, wherein each of the pixels comprises:

a light emitting device;

a first transistor configured to control a driving current, based on a voltage of a first node, the first transistor being coupled between a second node and a third node;

a second transistor coupled between one of the data lines and the second node, the second transistor being turned on by a first scan signal supplied to a first scan line;

a third transistor and a fourth transistor, coupled in series between the first node and the third node, the third transistor and the fourth transistor, being turned on by a second scan signal supplied to a second scan line; and a fifth transistor supplying the reference voltage to a fourth node between the third transistor and the fourth transistor, the fifth transistor being turned off by an emission control signal supplied to an emission control line.

* * * * *